United States Patent [19]

Okajima et al.

[11] Patent Number: 5,064,445

[45] Date of Patent: Nov. 12, 1991

[54] GRINDING TOOL AND METHOD OF MAKING THE SAME

[75] Inventors: Hiroshi Okajima; Susumu Sudo, both of Nagoya, Japan

[73] Assignees: Sankyo Rikagaku Co., Ltd., Tokyo; Tawekawa Tekko Kabushiki Kaisha, Aichi, both of Japan

[21] Appl. No.: 488,115

[22] Filed: Mar. 5, 1990

Related U.S. Application Data

[62] Division of Ser. No. 299,041, Jan. 19, 1989.

[30] Foreign Application Priority Data

Apr. 2, 1988 [JP] Japan ..... 63-81879

[51] Int. Cl.[5] ..... B24D 3/00

[52] U.S. Cl. ..... 51/293; 51/295; 51/298; 264/230

[58] Field of Search ..... 51/293, 295, 298; 264/230

[56] References Cited

U.S. PATENT DOCUMENTS

| | | | |
|---|---|---|---|
| 3,086,242 | 4/1963 | Cook et al. | 264/566 |
| 3,539,315 | 11/1970 | Bidwell | 51/293 |
| 3,687,647 | 8/1972 | Waller | 51/293 |
| 3,689,187 | 9/1972 | Hirosawa | 51/293 |
| 3,689,241 | 9/1972 | Armstrong | 51/309 |
| 3,741,192 | 6/1973 | Avery | 125/21 |
| 3,813,098 | 5/1974 | Fischer et al. | 273/67 A |
| 4,643,740 | 2/1987 | Nicolson | 51/293 |
| 4,669,239 | 6/1987 | Maggs et al. | 109/49.5 |
| 4,826,509 | 5/1989 | Schwämmle | 51/293 |
| 4,868,967 | 9/1989 | Holt et al. | 29/450 |

*Primary Examiner*—William R. Dixon, Jr.
*Assistant Examiner*—Willie J. Thompson
*Attorney, Agent, or Firm*—Bauer & Schaffer

[57] ABSTRACT

This invention relates to a grinding tool wherein a thermocontracting tube on which is formed a partial hone grain layer pattern in which parts having no hone grain layer are scattered is applied to cover the peripheral surface of a shaping base on which is formed a molding surface of a required shape and is then heated to closely adhere to the above mentioned molding surface and to a method of making such grinding tools.

4 Claims, 6 Drawing Sheets

FIG. 5(III)
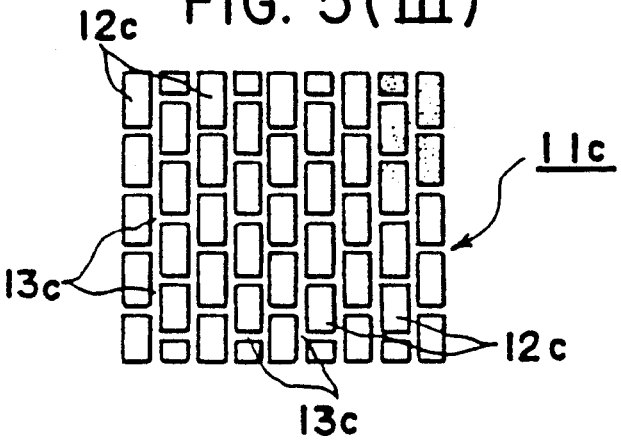

FIG. 6(III)
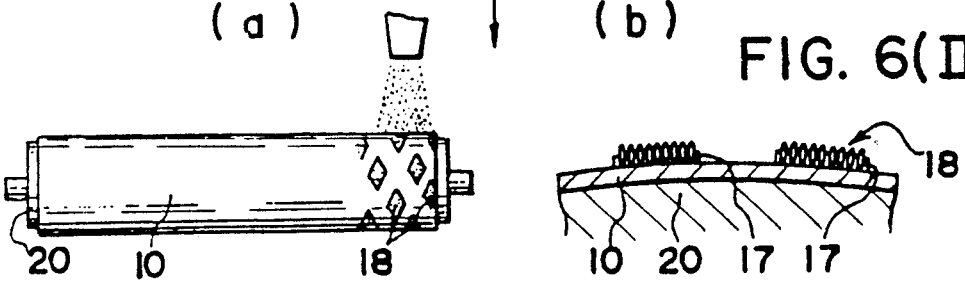

FIG. 6(V)
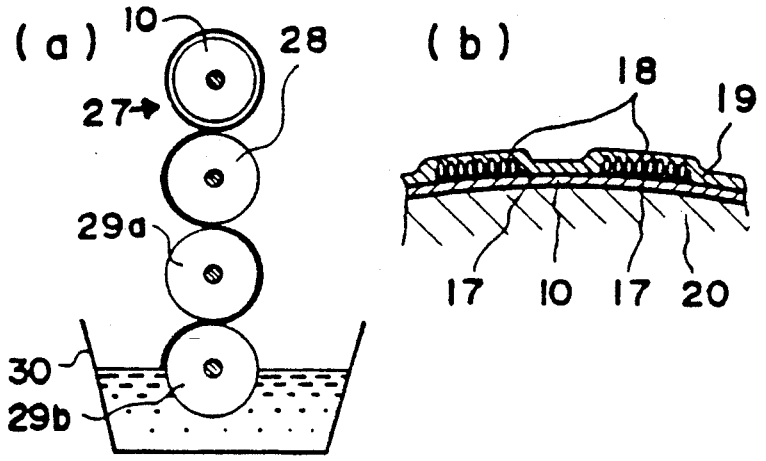
FIG. 6(VI)
Drying
FIG. 6(VII)
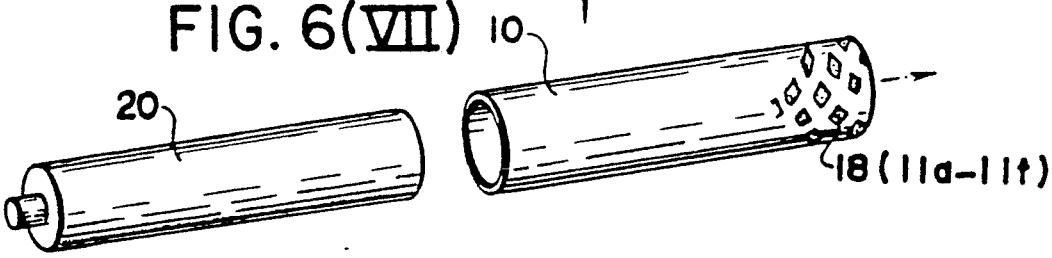
FIG. 6(VIII)
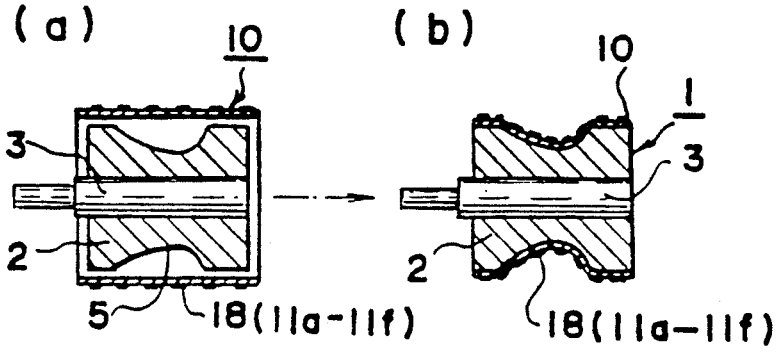

GRINDING TOOL AND METHOD OF MAKING THE SAME

This is a divisional of Ser. No. 299,041 filed: Jan. 19, 1989 pending.

FIELD OF THE INVENTION

This invention relates to a grinding tool for cutting and grinding such work as a wood or metal and to a method of making the same and is characterized by being most adapted to cut and grind such surface of a complicated shape particularly as a curved surface.

BACKGROUND OF THE INVENTION

In the case of working a wood, in cutting and grinding such surface of a complicated shape as a curved surface on the peripheral edge, it has been general that a treading pressure pad provided with a treading surface corresponding to the surface to be ground is arranged inside a sanding belt and is pressed against the work side to press the sanding belt against the work side. However, in such formation, there have been defects that, as the treading pressure pad is pressed against the sanding belt under tension to adapt the sanding belt to the surface to be ground, if the surface is a complicated curved surface, the adapting action will not be favorable and the work will be scraped away at the end edges by the upper and lower edges of the sanding belt.

On the other hand, in order to improve it, a shaping base having a molding surface adapted to the required ground surface of the work is formed and small pieces of sanding paper having a hone grain layer formed on the outer surface are pasted one by one along the axis on the peripheral surface of the shaping base to form a grinding surface to be pressed against the work while the shaping base is rotated.

However, in such formation, it is necessary to uniformly paste the paper pieces on the entire periphery and, when they are worn, it will be necessary to peel them off one by one and then to re-paste small pieces of new sanding paper. Thus, the workability has been very low.

Such technical problem is the same also in working metals. It is difficult to make a hone in a complicated shape. In replacing the hone with the above mentioned grinding tool for grinding works, there has been a defect that it is difficult to form the same hone grain layer as is mentioned above.

The present invention has it as an object to provide a grinding tool easy to make and a method of making the same.

SUMMARY OF THE INVENTION

In the grinding tool of the present invention, a shaping base provided with a molding surface adapted to the shape of the ground surface is coated on the peripheral surface with a thermocontracting tube and a partial hone grain layer pattern in which parts having no hone grain layer are scattered is formed on the surface of the above mentioned thermocontracting tube.

In this partial horn grain layer pattern, for example, numerous independent partial hone grain layers are scattered or many band-like partial hone grain layers are parallelly formed.

This grinding tool can be easily made by the folllwing steps that:

a) a shaping base provided with a molding surface adapted to the shape of a surface to be ground is formed;

b) a thermocontracting tube of a predetermined dimension is fitted to a columnar jig;

c) in a transferring apparatus comprising a transfer molding roll having the same pattern as a hone grain layer pattern formed to project on the peripheral surface and a feeding roll group rolling and depositing a bonding agent in a uniform thickness on the peripheral surface of the transfer molding roll, the transfer molding roll is synchronously rotated in external contact with a cylindrical columnar jig coated with the above mentioned thermocontracting tube;

d) hone grains are blown onto the peripheral surface of the thermocontracting tube of the columnar jig to bond the hone grains to a predetermined pattern of the bonding agent applied to paint the peripheral surface;

e) after the bonding agent is dried. the above mentioned thermocontracting tube is painted on the surface with an upper painting resin;

f) the thermocontracting tube is pulled off the columnar jig; and g) the shaping base is covered with the above mentioned thermocontracting tube and then the thermocontracting tube is heated and contracted to closely adhere to the molding surface of the above mentioned shaping base.

DETAILED DESCRIPTION OF THE INVENTION

An embodiment of the present invention shall be explained with reference to the accompanying drawings.

Figure 1:
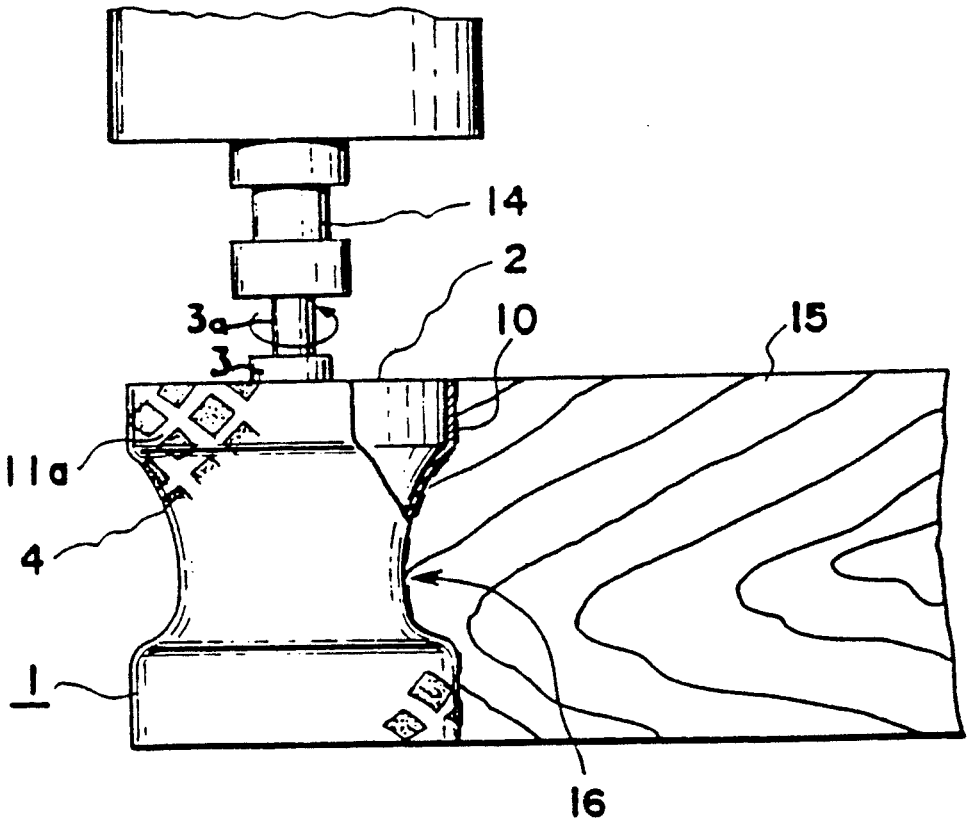
FIG. 1 is a partly sectioned side view showing a grinding tool 1 as being used.
Figure 2:
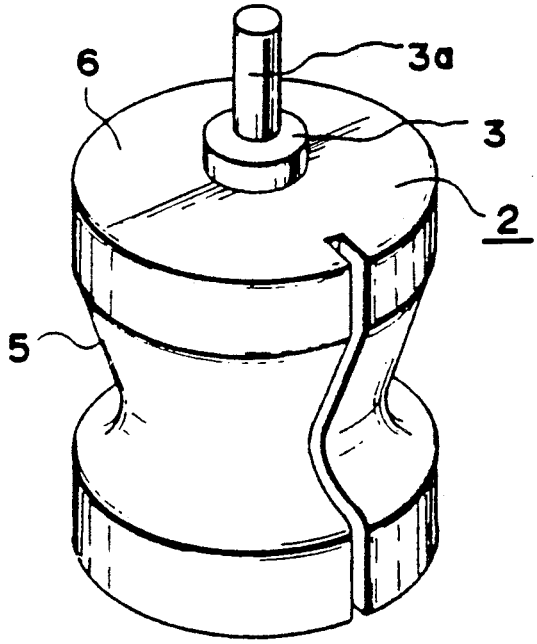
FIG. 2 is a perspective view of a shaping base 2.

In FIGS. 1 and 2, the reference numeral 1 represents a wheel-like grinding tool which is formed by covering a roll-like shaping base 2 on the outer surface with a thermocontracting tube 10, is arranged on the side of a grinding machine for working wood or the like with a supporting shaft 3*a* made integral with a core metal 3 and connected to a driving shaft 14 and presses a grinding surface 4 formed on the peripheral surface while being rotated against a ground surface 16 of a work 15 running in a moving path to grind the ground surface 16.

Figure 3:
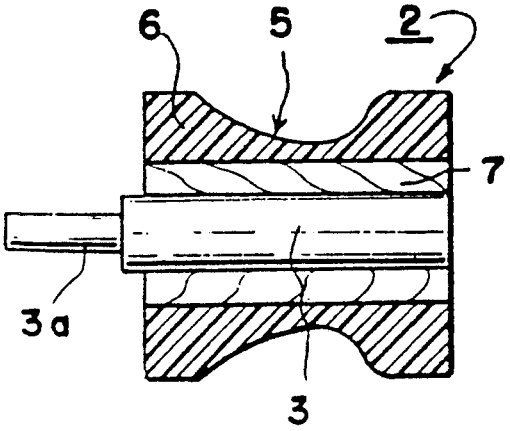
FIGS. 3 and 4 are vertically sectioned side views showing embodiments of the shaping base 2.
Figure 4:
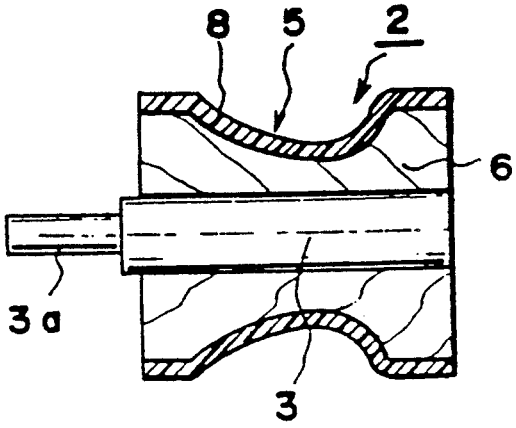

As shown in FIGS. 2 to 4, the above mentioned roll-like shaping base 2 is provided with a molding surface 5 adapted to the shape of the ground surface 16 of the work 15 and is formed by a means wherein a base mold 6 made of such moldable material as a wood, rubber, resin material, nonmetal or metal is fitted to the core metal 3, sanding paper or the like is pasted and fitted to the outside surface of the base mold 6 to form a pattern of the work 15 forming a hone grain surface and the base mold 6 is pressed while being rotated against the pattern to shape the work.

In case it is necessary to give a proper elasticity to the surface of the above mentioned shaping base 2 in order to improve the close contact with the ground surface of the work in working, the shaping base will be formed of a synthetic rubber or resin material. Or else, as shown in FIG. 3, a rigid core material 7 may be fitted on the peripheral surface with such soft base mold 6 as of a synthetic rubber or sponge or, as shown in FIG. 4, such thin small pieces 8 of a synthetic rubber or sponge may be bonded parallelly in the axial direction on the peripheral surface of the base mold 6.

A thermocontracting tube 10 is in close contact with the outer surface of the shaping base 2. Partial hone grain layer patterns 11*a* to 11*f* in which parts 13*a* to 13*f* having no hone grain layer are scattered are formed on the surface of the thermocontracting tube 10.

Figure 5I:
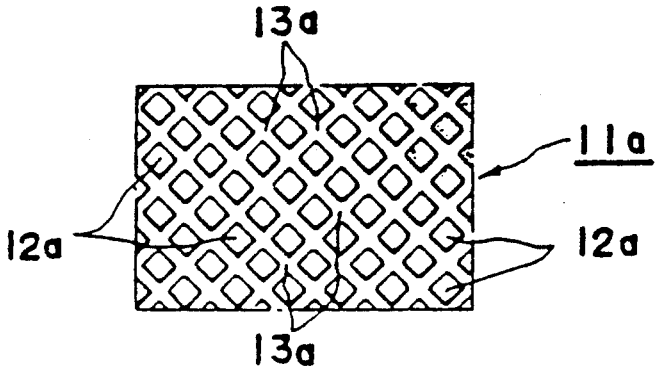
FIGS. 5(I) to (VI) are developed views of partial hone grain layer patterns 11*a* to 11*f* formed on a thermocontracting tube 10.

FIGS. 5(I) to (IV) show embodiments of partial hone grain layer patterns 11*a* to 11*d* wherein numerous independent partial hone grain layers 12*a* to 12*d* are spotted. By the way, FIGS. 5(I) to (VI) are shown as developed views respectively with the vertical direction as an axial direction.

Here, the partial hone grain layer pattern 11*a* shown in FIG. 5(I) is made like a lattice by arranging a plurality of parts 13*a* having no hone grain layer at regular intervals in the direction inclined by 45 degrees to form square independent partial hone grain layers 12*a* inclined by 45 degrees and enclosed by the parts 13*a* having no hone grain layer.

Figure 5:
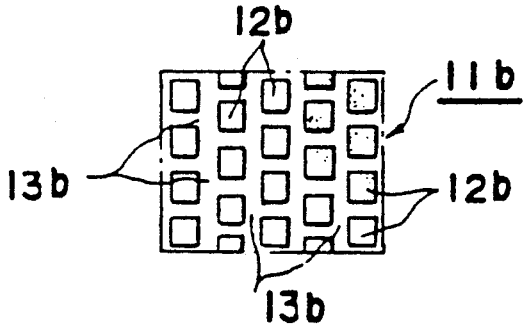
Figure 5:
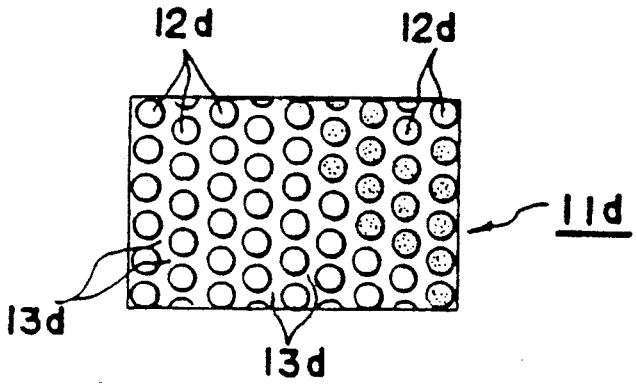

In the partial hone grain layer pattern 11*b* shown in FIG. 5(II), square independent partial hone grain layers 12*b* are arranged in the axial direction (vertical direction) but are checkered in the peripheral direction (horizontal direction) and parts 13*b* having no hone grain layer are formed around the respective hone grain layers 12*b*.

In the partial hone grain layer pattern 11*c* shown in FIG. 5(III). rectangular independent partial hone grain layers 12*c* are arranged like laid bricks and fine groove-like parts 13*c* having no hone grain layer are formed arround the respective partial hone grain layers 12.

In the partial hone grain layer pattern 11*d* shown in FIG. 5(IV), circular independent partial hone grain layers 12*d* are arranged and parts 13*d* having no hone grain layer are formed around them. By the way, the partial hone grain layers 12*d* may be elliptic.

Such other shapes of the independent partial hone grain layers than of the above mentioned endoscopes as such various shapes as a triangle, diamond and polygon can be suggested and various arrangements can be also suggested.

In case the thermocontracting tube 10 is in close contact with the peripheral surface of the above mentioned shaping base, the contracting rate of the above menmtioned thermocontracting tube 10 will be different in the respective parts due to the curvature of the molding surface 5 of the shaping base 2. Therefore, the thermocontracting tube 10 contracts differently in the peripheral direction and the axial direction. However, in the above mentioned respective formations, the partial hone grain layers 12*a* to 12*d* are enclosed with the parts 13*a* to 13*d* having no hone grain layer, are relatively smaller in the resistance and are more likely to extend and contract than the partial hone grain layers 12*a* to 12*d*. Therefore, these parts 13*a* to 13*d* having no hone grain layer contract greatly in the peripheral direction and axial direction in response to the contraction of the above mentioned thermocontracting tube 10. Therefore, the bonding aagent layers supporting the respective partial hone grain layers 12*a* to 12*d* are not greatly subjected to the contracting burden and therefore are not peeled off and the thermocontracting tube 10 can closely adhere to the peripheral surface of the shaping base 2.

Figure 5V:
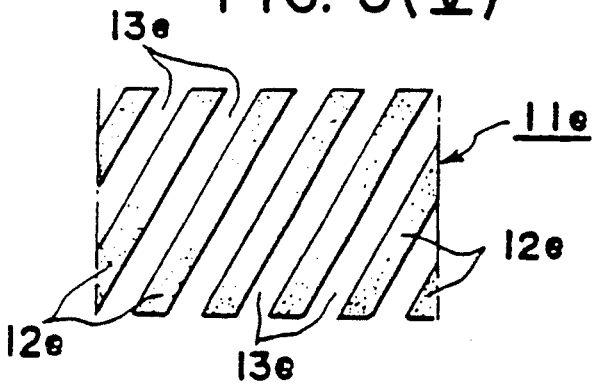
Figure 5:
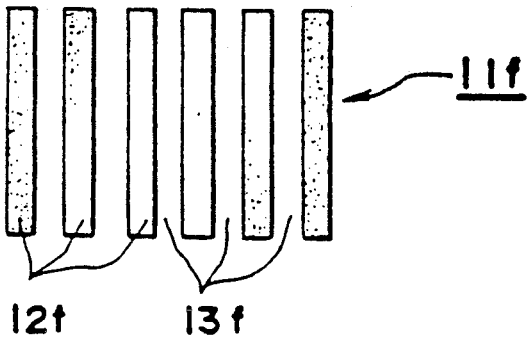

FIGS. 5(V) and (VI) show embodiments of the partial hone grain layer patterns 11*e* and 11*f* made of many parallely arranged band-like partial hone grain layers 12*e* and 12*f*.

Here, in the partial hone grain layer pattern 11*e* shown in FIG. 5(V), many band-like partial hone grain layers 12*e* inclined by about 30 degrees are parallelly provided in the peripheral direction and parts 13*e* having no hone grain layer and inclined by the same angle are scattered between the respective hone grain layers 12*e*. Even in such formation, the parts 13*e* having no hone grain layer can contract in the peripheral direction and in the axial direction due to the inclination and the hone grain layers 12*e* are not peeled off.

In the partial hone grain layer pattern 11*f* shown in FIG. 5(VI). the band-like partial hone grain layers 12*f* in the axial direction are parallelly provided at predetermined intervals in the peripheral direction and the parts 13*f* having no hone grain layer are scattered in the axial direction.

In such formations, the patterns contract in the peripheral direction but the contracting rate in the peripheral direction is so larger than in the axial direction that, even if the parts 13*f* having no hone grain layer are arranged only in the axial direction and can respond to the extension and contraction only in the peripheral direction, the expected effect of preventing the partial hone grain layers 12 from being peeled off will be able to be attained. (It is desirable that the contraction in the axial direction is also possible.)

As other modifications of the band-like partial hone grain layers, band-like partial hone grain layers inclined in the reverse direction may be overlapped and crossed with the above mentioned hone grain layers 12*e* or band-like partial hone grain layers in the axial direction may be crossed with band-like partial hone grain layers in the peripheral direction to form various crossed partial hone grain layer patterns.

In such formation wherein numerous independent partial hone grain layers 12*a* to 12*d* are spotted as in the above mentioned partial hone grain layer patterns 11*a* to 11*d*, as the parts 13*a* to 13*d* having no hone grain layer are more uniformly dispersed and formed over the peripheral surface of the thermocontracting tube 10, there is an advantage that the tube 10 can be favorably contracted.

On the other hand, in the formations of the partial hone grain layer patterns 11*e* and 11*f*, as the band-like partial hone grain layers 12*e* and 12*f* are parallelly arranged, there are advantages that the area of the hone grain layers can be secured to be large and, in case the later described manufacturing means is adopted, it will be easy to work projecting molds 23 of a transfer molding roll 22.

The producing process of the grinding tool of the above mentioned formation shall be explained in the following with reference to FIG. 6.

Figure 6I:
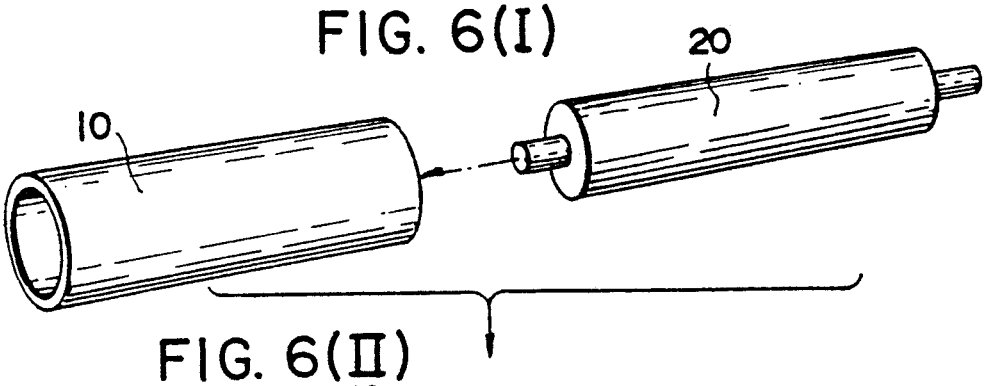
FIG. 6 is a step view showing a producing process of a grinding tool.

As in FIG. 6(I), the thermocontracting tube 10 is cut to be of a predetermined length and a columnar jig 20 made of steel or such resin as Teflon is fitted into the thermocontracting tube 10. The columnar jig 20 is made equal in the outside diameter to the inside diameter of the thermocontracting tube 10 and is smoothly finished on the peripheral surface to make it easy to insert. By the way, as mentiioned later, a mold separating layer may be formed in advance on the peripheral surface of the columnar jig 20 so that it may be easy to remove the thermocontracting tube 10 from the columnar jig 20.

Figure 6:
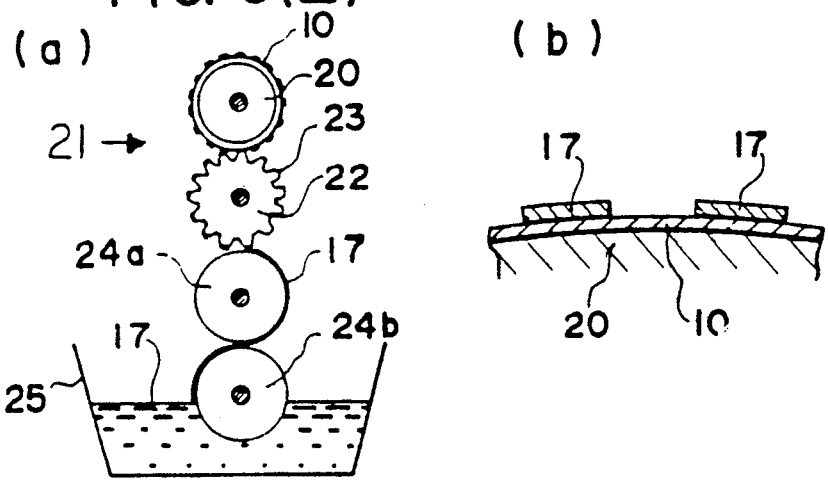
Figure 6:
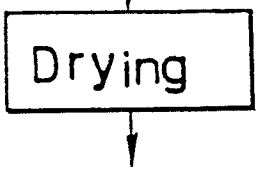

In FIG. 6(II)(a), the reference numeral 21 represents a transferring apparatus for forming a bonding layer pattern on the peripheral surface of the thermocontracting tube 10. In this transferring apparatus 21, the transfer molding roll 22 having the projecting molds 23 of the same pattern as the partial hone grain layer patterns 11*a* to 11*f* formed on the peripheral surface and feeding rolls 24*a* and 14*b* rolling and depositing a bonding agent 17 in a uniform thickness on the peripheral surface of the roll 22 are pivoted through a rotation controlling mechanism (not illustrated) and a liquid tank 25 storing such bonding agent 17 as an epoxy resin and feeding the bonding agent 17 to the lowermost feeding roll 24*b* is provided. The transfer molding roll 22 of this transferring apparatus 21 is made equal in the outside diameter to the thermocontracting tube 10 supported by the above mentioned columnar jig 20. The above mentioned columnar jig 20 has the shafts at both ends supported so as to externally contact the transfer molding roll 22 on the peripheral surface and is rotated by one rotation as synchronized with the above mentioned transfer molding roll 22 by the rotation controlling mechanism. Thereby, the bonding agent 17 within the liquid tank 25 is squeezed by the feeding rolls 24*a* and 24*b* to be of a predetermined thickness, is rolled and deposited on the projecting molds 23 of the above mentioned transfer molding roll 22 and is transferred in the same pattern as the pattern of the projecting molds 23 onto the peripheral surface of the thermocontracting tube 10 supported by the columnar jig 20 from the projecting molds 23 as shown in FIG. 6(II)(b).

In the structure of the projecting molds 23 of the above mentioned transfer molding roll 22, in the case of such pattern as the above mentioned partial hone grain layer pattern 11*a*, if the respective grooves are spirally ground and cut and are crossed with spiral grooves from the other direction, the parts 13*a* having no hone grain layer will be formed and it will be easy to form the projecting molds 23.

Also, in forming the above mentioned partial hone grain layer patterns 11*e* and 11*f*, the parts 13*e* and 13*f* having no hone grain layer may be ground and cut while being intermittently fed in the axial direction in turn per rotation and therefore it is easy to form the partial hone grain layer patterns 11*e* and 11*f*.

By the way, it is also possible by the known technique to form the partial hone grain layer patterns 11*b* to 11*d*.

Then, the columnar jig 20 holding the thermocontracting tube 10 on which the pattern of this bonding agent is formed is taken out of the transferring apparatus 21 and, as shown in FIG. 6(III)(a), hone grains are blown onto the pattern of the bonding agent 17 by an electrostatic painting method or a dropping method before the bonding agent dries while being supported by the columnar jig 20. Thereby, as shown in FIG. 6(III)(b), the hone grains are bonded by the bonding agent 17 and hone grain layers 18 of a predermined pattern is formed.

The thermocontracting tube 10 on which the hone grain layers 18 are formed and which is supported by the columnar jic 20 is dried by a warm wind drier at about 120° C. for 30 to 60 minutes (FIG. 6(IV)). By the way, even if dried at a high temperature, as the thermocontractng tube 10 is held by the columnar jig 20, there will be no trouble.

After this drying, an upper painting resin layer 19 is formed on the entire periphery of the thermocontracting tube 10 by a transferring apparatus 27 shown in FIG. 6(V)(a).

The above mentioned transferring apparatus 27 is of the same formation as of the transferring apparatus 21 and comprises a transfer roll 28, feeding rolls 29*a* and 29*b* for painting the transfer roll 28 with a resin in a predetermined thickness and a liquid tank 30. The thermocontracting tube 10 supported by the above mentioned columnar jic 20 is externally contacted with the transfer roll 28 and the thermocontracting tube 10 having the above mentioned hone grain layers 18 are painted on the entire surface with a resin. Thereby, as shown in FIG. 6(V)(b). the above mentioned hone grain layers 18 are covered with the upper painting resin layer 19, are stably held on the peripheral surface of the thermocontracting tube 10 and can resist the friction force at the time of grinding.

Further, the thermocontracting tube 10 is removed from the transferring apparatus 27, is dried (FIG. 6(VI)) the same as in the above and is pulled off the above mentioned columnar jig 20 (FIG. 6(VII)).

This surface treated thermocontracting tube 10 is long in the axial direction, is therefore cut to be of a length substantially equal to the width of the above mentioned shaping base 2, is then externally fitted to the shaping base 2 as shown in FIG. 6(VIII)(a) and is heated and contracted as in FIG. 6(VIII)(b) so as to closely adhere to the molding surface 2. This heating means is applied by passing the tube 10 through a furnace, dipping it in warm water or roasting it with fire. By the way, in this contraction, the parts 13*a* to 13*f* having no hone grain layer are formed in the partial hone grain layer patterns 11*a* to 11*f*, contract so well as not to force the above mentioned hone grain layers 12*a* to 12*f* to contract and therefore the hone grain layers 12*a* to 12*f* are not peeled off.

By such producing process, as shown in FIG. 1. the grinding tool 1 having the partial hone grain layer patterns 12*a* to 12*f* formed on the peripheral surface is completed.

The grinding tool 1 need not always be roll-like but may be such formation movable reciprocally relatively with the work as a non-rotor, for example, of a rectangular cross-section. Thus, acrdrding to the present invention, grinding tools in a wide range can be formed. The works to be ground by the grinding tool of the present inventiion are such various materials as a wood, metal and resin.

The thermocontracting tube in the above mentioned embodiments has a characteristic of quickly contracting in the diameter at a temperature of 70° to 130° C. Therefore, when a shaping base having a molding surface of a required shape formed in advance is prepared and a thermocontracting tube having hone grain layers formed on the outer peripheral surface is applied to cover the shaping base and is heated to closely adhere to the molding surface, a grinding tool provided on the peripheral surface with a grinding surface will be able to be made.

However, in case a bonding agent layer is formed on the entire surface of the above mentioned thermocontracting tube and hone grains are blown onto the bonding agent layer to form a hone grain layer, there will be the following problems:

That is to say, the above mentioned thermocontracting tube is to closely adhere by contraction to the shaping base on which various curved surfaces are formed. Now, the bonding agent layer carrying the above mentioned hone grain layer is greatly different in the contracting rate with heat from the thermocontracting tube and is hard to contract. Therefore, in case the above mentioned thermocontracting tube is to closely adhere to the shaping surface, in case the diameter of the shaping surface is smaller than the inside diameter before heating of the tube and a large diameter contracting amount is required, due to the difference in the contracting rate between the thermocontracting tube and the bonding agent layer, there will be defects that the bonding agent layer will peel off and will separate from the thermocontracting tube, foul products will be frequently made and the yield rate will reduce.

Now, in the present invention, the partial hone grain layer pattern in which the parts having no hone grain layer are scattered is formed on the above mentioned thermocontracting tube and therefore, when the above mentioned thermocontracting tube is heated, the tube will be hard to contract in the parts having respective hone grain layers which will become resistances but will greatly contract in the parts having no hone grain layer, therefore, the burden of the extension and contraction of the bonding agent layer supporting the hone grain layer will be reduced and the thermocontracting tube will closely adhere to the molding surface of the shaping base without peeling off the hone grain layers.

Also, the above mentioned method of making grinding tools makes it easy to form this partial hone grain layer pattern.

That is to say, in this producing process, by using a transferring apparatus comprising a transfer molding roll having the same pattern as the pattern of hone grain layers projected on the peripheral surface and a feeding roll group rolling and depositing a bonding agent in a uniform thickness on the peripheral surface of the above mentioned transfer molding roll, a columnar jig fitted with the above mentioned thermocontracting tube is externally contacted with the transfer molding roll and is synchronously rotated to form bonding agent layers on the outer surface of the tube in the same pattern as the partial hone grain layer pattern, further hone grains are blown onto these bonding agent layers to form hone grain layers in a predetermined pattern and the entire thermocontracting tube is painted with an upper painting resin to protect the above mentioned hone grain layers.

According to the present invention, as described above, a molding surface adapted to a ground surface 16 of a work 15 is formed on a shaping base, a thermocontracting tube having a partial hone grain layer pattern formed on the outer peripheral surface is applied to cover the above mentioned shaping base and is heated to closely adhere to the above mentioned molding surface to form a grinding tool and therefore the manufacturing method can be easily applied. The partial hone grain layer pattern formed on the above mentioned thermocontracting tube more contracts in the parts having no hone grain layer and therefore there are excellent effects that the hone grain layers are not peeled off with the contraction of the thermocontracting tube and the grinding tool can be made at a high yield.

What is claimed is:

1. The method of making a grinding or sanding tool comprising the steps of providing a rigid base having a surface comforming to the shape of the surface to be ground, applying to the surface of the base a heat shrinkable tube having its surface formed with abrasive material arrayed in a selected pattern and thereafter applying heat to said tube to shrink said tube and cause it to assume the shape conforming to said base and to adhere thereto.

2. A method acording to claim 1, including the steps of a) applying a heat shrinkable tube free of any surface contaminant on the base;

b) forming a transfer roll the peripheral surface of which is formed to conform to the selected pattern of abrasive material;

c) depositing a bonding agent in a uniform thickness on the peripheral surface of said transfer roll;

d) rotating the transfer roll synchronously in external contact with the tube on the base to transfer the bonding agent to said tube in the selected pattern;

e) applying abrasive grains onto the peripheral surface of the tube to provide a uniform layer of abrasive on the selected pattern of bonding agent applied thereto;

f) drying the bonding agent and abrasive layer of the above mentioned tube with a resin;

g) removing the tube from the base; and h) covering the shaped base with the tube.

3. The method according to claim 2, wherein the dried tube is covered with a protective resin.

4. The method according to claim 1, including the step of working the surface of the transfer roll to provide an array of grooves conforming to the areas of said selected pattern free of adhesive and abrasive.

* * * * *